US006790573B2

(12) United States Patent
Drappel et al.

(10) Patent No.: US 6,790,573 B2
(45) Date of Patent: Sep. 14, 2004

(54) MULTILAYERED IMAGING MEMBER HAVING A COPOLYESTER-POLYCARBONATE ADHESIVE LAYER

(75) Inventors: Stephan V. Drappel, Toronto (CA); Kathleen M. Carmichael, Williamson, NY (US); David J. Maty, Ontario, NY (US); John A. Bergfjord, Sr., Macedon, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/055,639

(22) Filed: Jan. 25, 2002

(65) Prior Publication Data

US 2003/0152855 A1 Aug. 14, 2003

(51) Int. Cl.[7] ..... G03G 5/14

(52) U.S. Cl. ..... 430/60; 430/131

(58) Field of Search ..... 430/60, 131

(56) References Cited

U.S. PATENT DOCUMENTS

| | | | | |
|---|---|---|---|---|
| 4,173,472 A | | 11/1979 | Berwick et al. | 430/60 |
| 4,238,596 A | | 12/1980 | Quinn | 528/179 |
| 4,265,990 A | | 5/1981 | Stolka et al. | 430/96 |
| 4,381,337 A | | 4/1983 | Chang | 430/60 |
| 4,464,450 A | | 8/1984 | Teuscher | 430/60 |
| 4,465,820 A | | 8/1984 | Miller et al. | 528/194 |
| 4,492,746 A | | 1/1985 | Miyakawa et al. | 430/71 |
| 4,582,772 A | | 4/1986 | Teuscher et al. | 430/62 |
| 4,584,253 A | | 4/1986 | Lin et al. | 430/60 |
| 4,588,667 A | | 5/1986 | Jones et al. | 430/73 |
| 4,595,602 A | * | 6/1986 | Schank | 430/67 |
| 4,737,414 A | | 4/1988 | Hirt et al. | 428/412 |
| 4,780,385 A | | 10/1988 | Wieloch et al. | 430/64 |
| 4,786,570 A | | 11/1988 | Yu et al. | 430/64 |
| 5,069,993 A | | 12/1991 | Robinette et al. | 430/66 |
| 5,084,526 A | * | 1/1992 | Harris et al. | 525/425 |
| 5,418,100 A | * | 5/1995 | Yu | |
| 5,422,213 A | | 6/1995 | Yu et al. | 430/60 |
| 5,484,674 A | | 1/1996 | Hor et al. | 430/78 |
| 5,571,649 A | | 11/1996 | Mishra et al. | 430/65 |
| 5,614,341 A | | 3/1997 | Mishra et al. | 430/60 |
| 5,660,961 A | | 8/1997 | Yu | 430/65 |
| 5,686,215 A | | 11/1997 | Bergfjord et al. | 430/63 |
| 5,709,974 A | | 1/1998 | Yuh et al. | 430/66 |
| 5,731,389 A | | 3/1998 | Bailly et al. | 525/437 |
| 5,830,613 A | | 11/1998 | Carmichael et al. | 430/64 |
| 5,891,594 A | | 4/1999 | Yuh et al. | 430/71 |
| 6,132,923 A | | 10/2000 | Maty et al. | 430/129 |
| 6,187,494 B1 | | 2/2001 | Kawamura et al. | 430/96 |
| 6,225,014 B1 | | 5/2001 | Patterson et al. | 430/64 |
| 6,287,737 B1 | | 9/2001 | Ong et al. | 430/58.8 |
| 6,294,300 B1 | | 9/2001 | Carmichael et al. | 430/58.8 |
| 6,303,254 B1 | | 10/2001 | Yu et al. | 430/60 |
| 6,309,785 B1 | | 10/2001 | Qi et al. | 430/58.8 |

FOREIGN PATENT DOCUMENTS

| | | | |
|---|---|---|---|
| EP | 0 730 005 A2 | | 9/1996 |
| JP | 60-12552 | * | 1/1985 |

OTHER PUBLICATIONS

Grant, R et al., ed, *Grant & Hackh's Chemical Dictionary*, McGraw–Hill Book Company, NY (1987), p. 448.*
Neufeldt, V et al., ed., *Webster's New World Dictionary*, Third College Edition, Webster's New World, NY (1988).*
U.S. Patent & Trademark Office English–Language Translation of JP 60–012552 (pub Dec. 2, 1985).*
Japanese Patent Office English–Language Abstract describing JP 60–12552 (pub Jan. 1985).*

(List continued on next page.)

*Primary Examiner*—Janis L. Dote
(74) *Attorney, Agent, or Firm*—Nixon Peabody LLP

(57) ABSTRACT

An imaging member including at least a support, a charge blocking layer, a charge imaging layer, and an interfacial adhesive layer including at least a copolyester-polycarbonate resin. A process for fabricating the imaging member is also disclosed.

30 Claims, 1 Drawing Sheet

OTHER PUBLICATIONS

Derwent Abstract Acc. No. 1985–054083 describing JP 60–12552, Sep. 1985.*

Americal Chemical Society Registry No. 71519–80–7, Copyright 2003 ACS.*

* cited by examiner

MULTILAYERED IMAGING MEMBER HAVING A COPOLYESTER-POLYCARBONATE ADHESIVE LAYER

FIELD OF THE INVENTION

This invention relates in general to electrophotography and, more specifically, to an imaging member including an adhesive layer containing for example a copolyester-polycarbonate resin, and processes for fabricating the imaging member.

BACKGROUND OF THE INVENTION

In electrophotography, an electrophotographic substrate (also referred to as a support or substrate support) containing a photoconductive insulating layer on a conductive layer is imaged by first uniformly electrostatically charging the surface. The plate is then exposed to a pattern of activating electromagnetic radiation, such as light. The light or other electromagnetic radiation selectively dissipates the charge in the illuminated areas of the photoconductive insulating layer while leaving behind an electrostatic latent image in the non-illuminated areas. This electrostatic latent image may then be developed to form a visible image by depositing finely divided electroscopic marking particles on the surface of the photoconductive insulating layer. The resulting visible image may then be transferred from the electrophotographic plate to a support such as paper. This image developing can be repeated as many times as necessary with reusable photoconductive insulating layers. The electrophotographic substrate is often referred to in the art as a electrophotographic imaging member, an electrostatographic imaging member, a photoconductive imaging member, a photoreceptor, a photoconductor, or the like.

Electrophotographic imaging members are well known. Typical electrophotographic imaging members include photosensitive members (photoreceptors) that are commonly utilized in electrophotographic (xerographic) processes in either a flexible belt or a rigid drum configuration. The electrophotographic imaging member may also be a flexible intermediate transfer belt. The flexible belt may be seamless or seamed. These belts are usually formed by cutting a rectangular sheet from a web, overlapping opposite ends, and welding the overlapped ends together to form a welded seam. These electrophotographic imaging members include a photoconductive layer having a single layer or composite layers. One type of composite photoconductive layer used in xerography is illustrated in U.S. Pat. No. 4,265,990, which describes a photosensitive member having at least two electrically operative layers.

An electrophotographic imaging member may take one of many different forms. For example, layered photoresponsive imaging members are known in the art. U.S. Pat. No. 4,265,990 describes a layered photoreceptor having separate photogenerating and charge transport layers. The photogenerating layer is capable of photogenerating holes and injecting the photogenerated holes into the charge transport layer. Thus, in photoreceptors of this type, the photogenerating material generates electrons and holes when subjected to light. More advanced photoconductive receptors contain highly specialized component layers. For example, a multilayered photoreceptor that can be employed in electrophotographic imaging systems can include one or more of a substrate, an undercoating layer, an optional hole or charge blocking layer, a charge generating layer (including photogenerating material in a binder) over the undercoating and/or blocking layer, and a charge transport layer (including charge transport material in a binder). Additional layers such as an overcoating layer or layers can also be included. See, for example, U.S. Pat. Nos. 5,891,594 and 5,709,974.

As more advanced, higher speed electrophotographic copiers, duplicators and printers were developed, degradation of image quality was encountered during extended cycling. Moreover, complex, highly sophisticated, duplicating and printing systems operating at very high speeds have placed stringent requirements, including narrow operating limits, on photoreceptors. For example, the numerous layers found in many modern photoconductive imaging members must be highly flexible, adhere well to adjacent layers, and exhibit predictable electrical characteristics within narrow operating limits to provide excellent toner images over many thousands of cycles.

One type of multilayered photoreceptor that has been employed as a belt in electrophotographic imaging systems includes a substrate, a conductive layer, a blocking layer, an adhesive layer, a charge generating layer, and a charge transport layer. This photoreceptor may also include additional layers such as an anti-curl backing layer and an overcoating layer. Although excellent toner images may be obtained with multilayered belt photoreceptors, it has been found that the numerous layers limit the versatility of the multilayered belt photoreceptor. For example, there is a great need for long service life flexible photoreceptors in compact imaging machines that employ small diameter support rollers for photoreceptors belt systems fitted into a very confined space. Small diameter support rollers are also highly desirable for simple, reliable copy paper stripping systems which utilize the beam strength of the copy paper to automatically remove copy paper sheets from the surface of a photoreceptor belt after toner image transfer. Unfortunately, small diameter rollers, e.g., less than about 0.75 inch (19 mm) diameter, raise the threshold of mechanical performance criteria to such a high level that spontaneous photoreceptor belt material failure becomes a frequent event for multilayered belt photoreceptors. Thus, in advanced imaging systems utilizing multilayered belt photoreceptors, cracking has been encountered in one or more critical photoreceptor layers during belt cycling over small diameter rollers. Cracks developed in charge transport layers during cycling were manifested as print-out defects which adversely affected copy quality. Frequent photoreceptor cracking has a serious impact on the versatility of a photoreceptor and reduces its practical value for automatic electrophotographic copiers, duplicators, and printers.

Moreover, seams in multilayered belt photoreceptors tend to delaminate during extended cycling over small diameter support rollers. Seam delamination is further aggravated when the belt is employed in electrophotographic imaging systems utilizing blade cleaning devices. In addition, belt delamination is encountered during web slitting operations to fabricate belt photoreceptors from wide webs. Alteration of materials in the various belt layers such as the conductive layer, blocking layer, adhesive layer, charge generating layer, and/or the charge transport layer to reduce delamination is not easily effected because the new materials may adversely affect the overall electrical, mechanical, and other properties of the belt, such as residual voltage, background, dark decay, flexibility, and the like.

Interfacial adhesive layers have been used in order to maintain mechanical strength of various multilayered electrophotographic imaging members. Typical interfacial adhesive layer materials include, for example, polyesters, MORESTER® 49,000 (available from Morton International, Inc.)

(also referred to a "MORTON® 49,000," "MORTON® 49K," and "49K"), VITEL® PE1100 (available from Bostik, Inc.), polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the charge blocking layer include spraying, dip coating, roll coating, wire wound rod coating, gravure coating, BIRD® applicator coating, and the like. Drying of the deposited coating may be effected by any suitable conventional technique, such as by oven drying, infra red radiation drying, air drying, and the like.

MORTON® 49,000 is a linear saturated copolyester reaction product of four diacids and ethylene glycol, in that it consists of alternating monomer units of ethylene glycol and four randomly sequenced diacids. MORTON® 49K has a weight average molecular weight of about 70,000 and a $T_g$ of about 32 degrees C. It is believed that the presence of the diacids containing alkylene groups in MORTON® 49,000 linear saturated copolyester adhesive layers contribute to the delamination of multilayered photoreceptors during transport over small diameter rollers.

SUMMARY OF THE INVENTION

The present invention relates to an imaging member comprising, for example, at least a support, a charge blocking layer, an interfacial adhesive layer including a copolyester-polycarbonate resin, and a charge imaging layer. The copolyester-polycarbonate resin includes at least a copolymer of bisphenol-A and a phthalic acid dichloride ester. Other layers may be incorporated into the imaging member of the present invention in embodiments thereof, including, without limitation, undercoatings, conductive coatings, underlayers, ground strip layers, blocking layers, anti-curl layers, overlayers, and the like.

The present invention also involves a process for fabricating imaging members. The process comprises, for example, providing a support, providing a charge blocking layer, providing a charge imaging layer, and forming an interfacial adhesive layer between the charge blocking layer and the charge imaging layer. The interfacial adhesive layer may or may not be in direct contact with either the charge blocking layer or the charge imaging layer.

One advantage of the present invention in embodiments thereof is the provision of an increase in the adhesive bond strength of the interfacial adhesive layer, which is achieved substantially without negatively impacting the overall electrical properties of the imaging member.

DETAILED DESCRIPTION OF THE INVENTION

Figure 1:
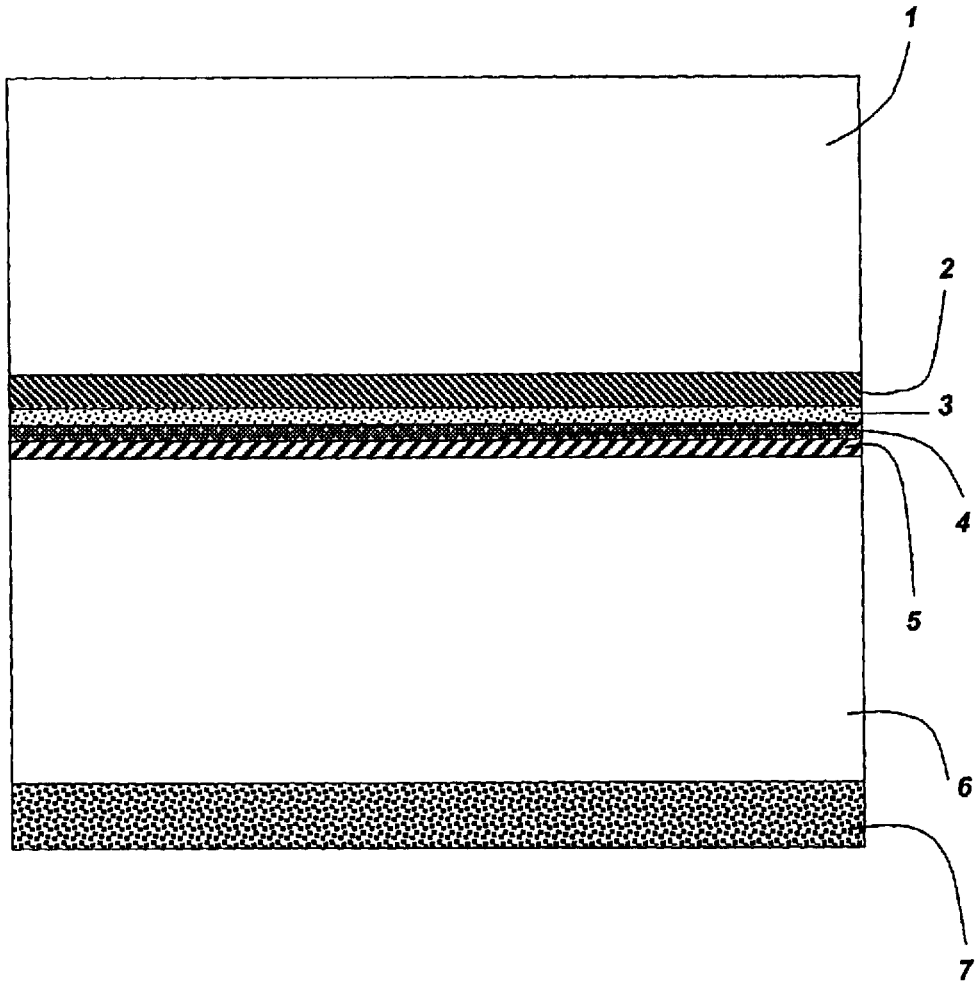
FIG. 1 generally illustrates an exemplary embodiment of an imaging member in accordance with the present invention.

The present invention relates to an imaging member useful in, for example, imaging and printing systems, including, without limitation, electrophotographic imaging, eiectrostatographic imaging, digital imaging, and color imaging systems. The imaging member of the present invention has a support, a charge blocking layer, an interfacial adhesive layer including a copolyester-polycarbonate resin, and a charge imaging layer. Further, the charge imaging layer may include a charge generating layer and a charge transport layer. In one embodiment, the interfacial adhesive layer can be disposed between the charge blocking layer and the charge imaging layer. In embodiments in which the charge imaging layer includes a charge generating layer and a charge transport layer, the interfacial adhesive layer can be disposed between the charge blocking layer and the charge generating layer. The terms "imaging member" and "photoconductor" are used interchangeably throughout the present application. In one embodiment, the interfacial adhesive layer has an adhesive strength of between about 5.0 and about 30.0 g/cm, as measured using a reverse peel test as described in Example 5 of the present application. In another embodiment, the imaging member has an adhesive strength of at least 100 g/cm, as measured using a 90-degree normal peel test as described in Example 5 of the present application.

The present invention also relates to a method for fabricating an imaging member. This method involves providing a support, a charge blocking layer, and a charge imaging layer, and forming an interfacial adhesive layer between the charge blocking layer and the charge imaging layer, where the interfacial adhesive layer includes a copolyester-polycarbonate resin, as described in more detailed herein.

FIG. 1 illustrates one embodiment of an imaging member of the present invention, where the imaging member includes a charge transport layer 1, a charge generating layer 2, an interfacial adhesive layer 3, a charge blocking layer 4, an electrically conductive ground plane 5, a support 6, and an anti-curl layer 7.

The support (also referred to as a "substrate") may be opaque or substantially transparent and may include numerous suitable materials having the required mechanical properties. The support may further be provided with an electrically conductive surface. Accordingly, the support may include a layer of an electrically non-conductive or conductive material such as an inorganic or organic composition. As electrically non-conducting materials, there may be employed various resins known for this purpose, including polyesters, polycarbonates, polyamides, polyurethanes, and the like. The electrically insulating or conductive substrate may be rigid or flexible and may have any number of different configurations such as, for example, a plate, a cylinder, a sheet, a scroll, a flexible web, an endless flexible belt, and the like. The substrate may be in the form of an endless flexible belt and includes a commercially available biaxially oriented polyesters known as MYLAR®, or as MELINEX®, both available from DUPONT®-TEIJIN® Films.

The thickness of the support layer depends on numerous factors, including mechanical and economical considerations, and thus this layer for a flexible belt may be of substantial thickness, for example, over 200 micrometers, or of minimum thickness, for example, less than 50 micrometers, provided there are no adverse affects on the final photoconductive device. In one flexible belt embodiment, the thickness of this layer ranges from about 65 micrometers to about 150 micrometers. In another embodiment, the thickness may range from about 75 micrometers to about 125 micrometers for optimum flexibility and minimum induced surface bending stress when cycled around small diameter rollers, e.g., 12 millimeter diameter rollers.

The entire support may be made up of electrically conductive material or may include multiple layers in which an outer layer includes an electrically conductive material. If the support is coated with a conductive layer, the conductive layer may vary in thickness over substantially wide ranges depending on the optical transparency and degree of flexibility desired for the imaging member. Accordingly, for a flexible imaging device, the thickness of the conductive layer may be between about 20 angstroms to about 750 angstroms. In another embodiment, the thickness of the conductive layer may be between about 100 angstroms to about 200 angstroms for an optimum combination of electrical conductivity, flexibility, and light transmission. The flexible conductive layer may be an electrically conductive metal layer formed, for example, on the substrate by any suitable coating technique, such as a vacuum depositing technique. Typical metals include aluminum, copper, copper iodide, brass, gold, zirconium, titanium, niobium, tantalum, vanadium, hafnium, titanium, nickel, stainless steel, chromium, tungsten, molybdenum, and the like, and mixtures thereof. Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer.

The metal layer may include zirconium and/or titanium. The zirconium and/or titanium layer may be formed by any suitable coating technique, such as vacuum depositing technique. Typical vacuum depositing techniques include sputtering, magnetron sputtering, RF sputtering, and the like. Magnetron sputtering of zirconium or titanium onto a metallized substrate can be effected by a conventional type sputtering module under vacuum conditions in an inert atmosphere such as argon, neon, or nitrogen using a high purity zirconium or titanium target. The vacuum conditions are not particularly critical. In general, a continuous zirconium or titanium film can be attained on a suitable substrate, e.g., a polyester web substrate such as MYLAR® available from DUPONT®-TEIJIN® Films with magnetron sputtering. It should be understood that vacuum deposition conditions may all be varied in order to obtain the desired zirconium or titanium thickness. Typical techniques for forming the zirconium and titanium layers are described in U.S. Pat. Nos. 4,780,385 and 4,588,667, the entire disclosures of which are incorporated herein in their entirety.

The conductive layer may include a plurality of metal layers with the outermost metal layer (i.e., the layer closest to the charge blocking layer) including at least 50 percent by weight of zirconium, titanium, or mixtures thereof. In another embodiment, at least 70 percent by weight of zirconium and/or titanium may be used in the outermost metal layer. The multiple conductive layers may, for example, all be vacuum deposited or a thin layer can be vacuum deposited over a thick layer prepared by different techniques such as by casting. Thus, as an illustration, a zirconium metal layer may be formed in a separate apparatus than that used for previously depositing a titanium metal layer or multiple conductive layers can be deposited in the same apparatus with suitable partitions between the chamber utilized for depositing the titanium layer and the chamber utilized for depositing the zirconium layer. The titanium layer may be deposited immediately prior to the deposition of the zirconium metal layer. Generally, for rear erase exposure, a conductive layer light transparency of at least about 15 percent is desirable. If the zirconium and/or titanium layer is sufficiently thick to be self supporting, no additional underlying member is needed and the zirconium and/or titanium layer may function as both a substrate and a conductive ground plane layer. Ground planes including zirconium tend to continuously oxidize during xerographic cycling due to anodizing caused by the passage of electric currents, and the presence of this oxide layer tends to decrease the level of charge deficient spots with xerographic cycling. Generally, a zirconium layer thickness of at least about 100 angstroms is desirable to maintain optimum resistance to charge deficient spots during xerographic cycling. A typical electrical conductivity for conductive layers for imaging members in slow speed copiers is about $10^2$ to $10^3$ ohms/square.

After formation of an electrically conductive surface, a charge blocking layer may be applied thereto to photoreceptors. Generally, electron blocking layers for positively charged photoreceptors allow holes from the imaging surface of the photoreceptor to migrate toward the conductive layer. Any suitable blocking layer capable of forming an electronic barrier to holes between the adjacent photoconductive layer and the underlying conductive layer may be utilized. The blocking layer may be nitrogen containing siloxanes or nitrogen containing titanium compounds as disclosed, for example, in U.S. Pat. No. 4,338,387, U.S. Pat. No. 4,286,033, and U.S. Pat. No. 4,291,110. The disclosures of these patents are incorporated herein in their entirety. In one embodiment, the blocking layer may include a reaction product between a hydrolyzed silane and the oxidized surface of a metal ground plane layer. The blocking layer may be applied by any suitable conventional technique such as spraying, dip coating, draw bar coating, gravure coating, silk screening, air knife coating, reverse roll coating, vacuum deposition, chemical treatment, and the like. For convenience in obtaining thin layers, the blocking layers may be applied in the form of a dilute solution, with the solvent being removed after deposition of the coating by conventional techniques such as by vacuum, heating, and the like.

Any conventional charge blocking layer may be employed. A conventional charge blocking layer can include polymers, such as polyvinyl butyral, epoxy resins, polyesters, polysiloxanes, polyamides, polyurethanes, and the like; nitrogen-containing siloxanes or nitrogen-containing titanium compounds, such as trimethoxysilyl propyl ethylene diamine, N-beta(aminoethyl) gamma-aminopropyl trimethoxy silane, isopropyl 4-aminobenzene sulfonyl titanate, di(dodecylbenezene sulfonyl) titanate, isopropyl di(4-aminobenzoyl)isostearoyl titanate, isopropyl tri (N-ethyl amino) titanate, isopropyl trianthranil titanate, isopropyl tri(N,N-dimethyl-ethyl amino) titanate, titanium-4-amino benzene sulfonate oxyacetate, titanium 4-aminobenzoate isostearate oxyacetate, gamma-aminobutyl methyl dimethoxy silane, gamma-aminopropyl methyl dimethoxy silane, and gamma-aminopropyl trimethoxy silane, as disclosed in U.S. Pat. Nos. 4,338,387, 4,286,033, and 4,291,110, the disclosures of which are incorporated herein in their entirety.

A conventional charge blocking layer should be continuous and can have a thickness of up to 2 micrometers depending on the type of material used. However, a conventional blocking layer may have a thickness of less than about 0.5 micrometer because greater thicknesses may lead to undesirably high residual voltage. A blocking layer between about 0.005 micrometer and about 0.3 micrometer is satisfactory for most applications because charge neutralization after the exposure step is facilitated and good electrical performance is achieved. A thickness between about 0.03 micrometer and about 0.06 micrometer may be used for blocking layers for optimum electrical behavior.

Any suitable hole blocking layer capable of forming an electric barrier to holes between the adjacent photoconductive layer and the underlying conductive layer may be utilized. A hole blocking layer may include any suitable material. Typical hole blocking layers utilized for negatively charged photoreceptors can include, for example, Luckamide (a polyamide film forming polymer available from DAI NIPPON® Ink), hydroxy alkyl methacrylates, nylons, gelatin, hydroxy alkyl cellulose, organopolyphosphazines, orgariosilanes, organotitanates, organozirconates, silicon oxides, zirconium oxides, and the like. In one embodiment, the conventional hole blocking layer may include a reaction product of a hydrolyzed silane or a mixture of hydrolyzed silanes and the oxidized surface of a metal ground plane layer. The oxidized surface inherently forms on the outer surface of most metal ground plane layers when exposed to air after deposition. This combination enhances electrical stability at low relative humidity. The hydrolyzed silanes can then be used as is well known in the art. For example, see U.S. Pat. No. 5,091,278, the disclosure of which is incorporated herein in its entirety.

The interfacial adhesive layer of the present invention involves a copolyester-polycarbonate resin including at least a dihydric phenol constituent and an acid dichloride constituent. The interfacial adhesive layer of the present invention enhances the adhesive strength of the multilayered contacting surfaces. Suitable copolyester-polycarbonate resins for use in the present invention are disclosed in and may be prepared by the methods described in U.S. Pat. Nos. 3,169,121; 3,030,331; 4,156,069; 4,194,038; 4,330,663; and 4,438,255, the entire disclosures of which are hereby incorporated herein by reference. The dihydric phenol constituent may include bisphenol-A and the acid dichloride constituent may include isophthaloyl dichloride, terephthaloyl dichloride, and mixtures thereof.

In embodiments, the copolyester-polycarbonate resin includes a copolymer of bisphenol-A and a phthalic acid dichloride ester, where the copolyester-polycarbonate resin includes a polymer chain represented by the following formula: $(X.Y.Z.T)_n$, where:

X is a compound having an empirical formula of $C_{15}H_{16}O_2$, represented by the following structure:

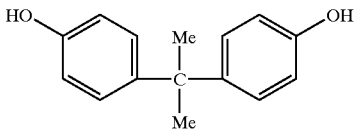

Y is a compound having an empirical formula of $C_8H_4Cl_2O_2$, represented by the following structure:

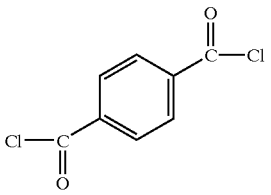

Z is a compound having an empirical formula of $C_8H_4Cl_2O_2$, represented by the following structure:

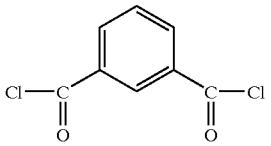

T is a compound having an empirical formula of $CCl_2O$, represented by the following structure:

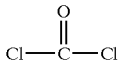

where "n" is an integer of about 1 to 1000. In embodiments, "n" is an integer of about 100 to 500. In other embodiments, "n" is an integer of about 200 to 300.

Further, the polymer chain may have a molecular topology that is either linear, branched, crosslinked, or combinations thereof.

The copolyester-polycarbonate resin has a weight average molecular weight, as measured by Gel Permeation Chromatography using dichloromethane as eluent and polystyrene standards of, for example, about 110,000 to about 500,000. In other embodiments, the weight average molecular weight of the copolyester-polycarbonate resin may be about 150,000 to about 300,000. In yet other embodiments, the weight average molecular weight of the copolyester-polycarbonate resin may be about 175,000 to about 225,000. In yet another embodiment, the weight average molecular weight of the copolyester-polycarbonate resin may be about 200,000. An example of this type of copolyester-polycarbonate resin is commercially available from General Electric under the name LEXAN® ML5273 and is identified as a copolymer (bisphenol-A/phthalic acid dichloride ester carbonate) (PeE), CAS Registry number 71519-80-7.

In one embodiment, the copolyester-polycarbonate resin of the present invention can include, for example, 1,3-beuzenedicarbonyl dichloride, polymer with 1,4-benzenedicarbonyl dichloride carbonic dichloride and 4,4'-(1-methylethylidene)bis[phenol], which is also commonly referred to in the art as having the following common names; 1,4-benzenedicarbonyl dichloride, polymer with 1,3-benzenedicarbonyl dichloride, carbonic dichloride and 4,4'-(1-methylethylidene)bis[phenol]-(9CI); carbonic dichloride, polymer with 1,3-benzenedicarbonyl dichloride, 1,4-benzenedicarbonyl dichloride and 4,4'-(1-methylethylidene) bis[phenol]-(9CI); phenol, 4,4'-(1-methylethylidene)bis-, polymer with 1,3-benzenedicarbonyl dichloride, 1,4-benzenedicarbonyl dichloride and carbonic dichloride-(9CI); bisphenol A-isophthaloyl chloride-phosgene-terephthaloyl chloride copolymer, and bisphenol A-isophthaloyl dichloride-phosgene-terepbthaloyl dichloride copolymer.

The interfacial adhesive layer may have a dry thickness between about 50 and about 5,000 Ångstroms. In another embodiment, the interfacial adhesive layer may have a dry thickness between about 100 and 3,000 Ångstroms. In yet another embodiment, the interfacial adhesive layer may have a dry thickness between about 300 and 1,000 Ångstroms.

The charge imaging layer may include any suitable photogenerating layer, and may be applied to the blocking layer, the interfacial adhesive layer, or intermediate layer if one is employed, which can then be overcoated with a contiguous hole transport layer as described below. As used herein, the term "charge imaging layer" is used interchangeably with "photogenerating layer." Further, the charge imaging layer may include a charge generating layer and a charge transport layer. In embodiments having a charge imaging layer made of a charge generating layer and a charge transport layer, the interfacial adhesive layer can be disposed between the charge blocking layer and the charge generating layer.

Examples of photogenerating layers include, but are not limited to, inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigments such as the X-form of metal free phthalocyanine described in U.S. Pat. No. 3,357,989 (the disclosure of which is incorporated herein by reference in its entirety), metal phthalocyanincs such as vadadyl phthalocyanine, hydroxygallium phthalocyanine, and copper phthalocyanine, dibromoanthanthrone, squarylium, quinacridones available from DUPONT® under the tradename MONASTRAL® Red, MONSTRAL® violet and MONASTRAL® Red Y, Vat orange 1 and Vat orange 3 trade names for dibromo anthanthrone pigments, benzimidazole perylene (BzP), perylene pigments as disclosed in U.S. Pat. No. 5,891,594 (the entire disclosure of which is incorporated herein by reference), substituted 2,4-diamino-triazines disclosed in U.S. Pat. No. 3,442,781 (the entire disclosure of which is incorporated herein by reference), polynuclear aromatic quinones available from Allied Chemical Corporation under the tradename INDOFAST® Double Scarlet, INDOFAST® Violet Lake B, INDOFAST® Brilliant Scarlet and INDOFAST® Orange, and the like dispersed in a film forming polymeric binder.

Selenium, selenium alloy, benzimidazole perylene, and the like and mixtures thereof may be formed as a continuous, homogeneous photogenerating layer. Benzimidazole perylene compositions are well known and described, for example, in U.S. Pat. No. 4,587,189, the entire disclosure thereof being incorporated herein by reference. Multi-photogenerating layer compositions may be utilized where a photoconductive layer enhances or reduces the properties of the photogenerating layer. Examples of this type of configuration are described in U.S. Pat. No. 4,415,639, the entire disclosure of this patent being incorporated herein by reference. Other suitable photogenerating materials known in the art may also be utilized, if desired.

Charge generating binder layers including particles or layers including a photoconductive material such as vanadyl phthalocyanine, metal free phthalocyanine, hydroxygallium phthalocyanine, benzimidazole perylene, amorphous selenium, trigonal selenium, selenium alloys such as selenium-tellurium, selenium-telluriumarsenic, selenium arsenide, and the like and mixtures thereof may be used because of their sensitivity to white light. Vanadyl phthalocyanine, metal free phthalocyanine, hydroxygallium phthalocyanine, and tellurium alloys may be used because these materials provide the additional benefit of being sensitive to infra-red light.

Any suitable optional polymeric film forming binder material may be employed as the matrix in the photogenerating binder layer. Typical polymeric film forming materials include, but are not limited to, those described, for example, in U.S. Pat. No. 3,121,006, the entire disclosure of which is incorporated herein by reference. Thus, typical organic polymeric film forming binders include, but are not limited to, thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, and the like, and mixtures thereof. These polymers may be block, random, or alternating copolymers.

The photogenerating composition or pigment may be present in the resinous binder composition in various amounts. Generally, however, the photogenerating composition or pigment may be present in the resinous binder in an amount of from about 5 percent by volume to about 90 percent by volume of the photogenerating pigment dispersed in about 10 percent by volume to about 95 percent by volume of the resinous binder, or alternatively from about 30 percent by volume to about 60 percent by volume of the photogenerating pigment is dispersed in about 40 percent by volume to about 70 percent by volume of the resinous binder composition. In one embodiment, about 8 percent by volume of the photogenerating pigment is dispersed in about 92 percent by volume of the resinous binder composition.

The photogenerating layer containing photoconductive compositions and/or pigments and the resinous binder material generally ranges in thickness of from about 0.1 micrometer to about 5.0 micrometers, or, alternatively, has a thickness of from about 0.3 micrometer to about 3 micrometers. The photogenerating layer thickness is generally related to binder content. Thus, for example, higher binder content compositions generally require thicker layers for photogeneration. The charge generating layer may have a thickness of about 1 micron prior to forming the charge transport layer and said charge generating layer may have a thickness of about 1 micron after the charge transport layer. Thickness outside these ranges can be selected providing the objectives of the present invention are achieved.

In addition to the binder materials and the charge generating materials, described above, the charge generating layer of the photoreceptors of the present invention also contain an appropriate amount of a charge transport material. The charge transporting material may be uniformly or homogeneously mixed with the binder material and the charge generating material, to form a uniform or homogeneous (or at least substantially so) composition throughout the charge generating layer. However, in embodiments, the charge transport material may be incorporated into the charge generating layer in such a form as to provide a concentration gradient of the charge transport material. In this embodiment, the concentration gradient is provided such that the lower concentration of the charge transport material is located furthest from the subsequently applied charge transport layer, and the higher concentration of the charge transport material is located nearest to the subsequently applied charge transport layer.

Any suitable and conventional technique may be utilized to mix and thereafter apply the photogenerating layer coating mixture. Typical application techniques include spraying, dip coating, roll coating, wire wound rod coating, and the like. Drying of the deposited coating may be effected by any suitable conventional technique such as oven drying, infra red radiation drying, air drying and the like.

Examples of photosensitive members having at least two electrically operative layers include the charge generator layer and diamine containing transport layer members disclosed in U.S. Pat. No. 4,265,990, U.S. Pat. No. 4,233,384, U.S. Pat. No. 4,306,008, U.S. Pat. No. 4,299,897, and U.S. Pat. No. 4,439,507. The disclosures of these patents are incorporated herein in their entirety. The photoreceptors may include, for example, a charge generator layer sandwiched between a conductive surface and a charge transport layer as described above or a charge transport layer sandwiched between a conductive surface and a charge generator layer.

If desired, a charge transport layer may include electrically active resin materials instead of mixtures of inactive resin materials with activating compounds. Electrically active resin materials are well known in the art. Typical electrically active resin materials include, for example, polymeric arylamine compounds and related polymers described in U.S. Pat. No. 4,801,517, U.S. Pat. No. 4,806,444, U.S. Pat. No. 4,818,650, U.S. Pat. No. 4,806,443, and U.S. Pat. No. 5,030,532, the disclosure of which are incorporated herein by reference in their entirety. Polyvinylcarbazole and derivatives of Lewis acids are described in U.S. Pat. No. 4,302,521, the entire disclosure of which is herein incorporated by reference. Electrically active polymers also include polysilylenes such as poly(methylphenyl silylene), poly(methylphenyl silylene-co-dimethyl silylene), poly (cyclohexylmethyl silylene), poly(tertiarybutylmethyl silylene), poly(phenylethyl silylene), poly(n-propylmethyl silylene), poly(p-tolylmethyl silylene), poly (cyclotrimethylene silylene), poly(cyclotetramethylene silylene), poly(cyclopentamethylene silylene), poly(di-t-butyl silylene-co-di-methyl silylene), poly(diphenyl silylene-co-phenylmethyl silylene), poly(cyanoethylmethyl silylene), and the like. Vinylaromatic polymers such as polyvinyl anthracene, polyacenaphthylene; formaldehyde condensation products with various aromatics such as condensates of formaldehyde and 3-bromopyrene; 2,4,7-trinitrofluorenone, and 3,6-dinitro-N-t-butylnaphthalimide as described in U.S. Pat. No. 3,972,717, the entire disclosure of which is incorporated herein by reference. Other polymeric transport materials include poly-1-vinylpyrene, poly-9-vinylanthracene, poly-9-(4-pentenyl)-carbazole, poly-9-(5-hexyl)-carbazole, polymethylene pyrene, poly-1-(pyrenyl)-butadiene, polymers such as alkyl, nitro, amino, halogen, and hydroxy substitute polymers such as poly-3-amino carbazole, 1,3-dibromo-poly-N-vinyl carbazole and 3,6-dibromo-poly-N-vinyl carbazole and numerous other transparent organic polymeric transport materials as described in U.S. Pat. No. 3,870,516, the entire disclosure of which is incorporated herein by reference.

The active charge transport layer may include an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer. In one embodiment, the transport layer employed in one of the two electrically operative layers in the multilayered photoconductor of this invention includes from about 25 percent to about 75 percent by weight of at least one charge transporting aromatic amine compound, and about 75 percent to about 25 percent by weight of a polymeric film forming resin in which the aromatic amine is soluble.

The charge transport layer forming mixture may include an aromatic amine compound. Examples of charge transporting aromatic amines represented by the structural formulae above for charge transport layers capable of supporting the injection of photogenerated holes of a charge generating layer and transporting the holes through the charge transport layer include, for example, triphenylmethane, bis(4-diethylamine-2-methylphenyl) phenylmethane; 4'-4"-bis(diethylamino)-2',2"-dimethyltriphenylmethane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis (chlorophenyl)-[1,1'-biphenyl]-4,4'-diamine, N,N'-diphenyl-N,N'-bis(3"-methylphenyl)-(1,1'-biphenyl)-4,4'-diamine, and the like dispersed in an inactive resin binder.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like.

Generally, the thickness of the charge transport layer is between about 2 micrometers and about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layer may be maintained from about 2:1 to 200:1 and in some instances as great as 400:1. The charge transport layer may extend from the first parallel side to the second parallel side of the imaging member. In another embodiment, the imaging member has a narrow ground strip layer along the first parallel side of the imaging member adjacent to and in edge to edge contact with the charge transport layer, the edge contact extending parallel to the first parallel side.

The charge transport layer may include any suitable transparent organic polymer or non-polymeric material capable of supporting the injection of photogenerated holes or electrons from the charge generating layer and allowing the transport of these holes or electrons through the organic layer to selectively discharge the surface charge. The charge transport layer not only serves to transport holes or electrons, but also protects the photoconductive layer from abrasion or chemical attack. The charge transport layer is normally transparent in a wavelength region in which the imaging member is to be used when exposure is effected therethrough to ensure that most of the incident radiation is utilized by the underlying charge generating layer. The charge transport layer should exhibit negligible charge generation, and discharge, if any, when exposed to a wavelength of light useful in xerography, e.g., 4000 to 9000 Angstroms. When used with a transparent substrate, imagewise exposure or erase may be accomplished through the substrate with all light passing through the substrate. In this case, the charge transport material need not transmit light in the wavelength region of use if the charge generating layer is sandwiched between the substrate and the charge transport layer. The charge transport layer in conjunction with the charge generating layer is an insulator to the extent that an electrostatic charge placed on the charge transport layer is not conducted in the absence of illumination. The charge transport layer should trap minimal charges either holes or electrons as the case may be passing through it. Charge transport layer materials are well known in the art.

Any suitable inactive resin binder soluble in methylene chloride or other suitable solvents may be employed for the charge transport layer. Typical inactive resin binders soluble in methylene chloride include polycarbonate resin, polyvinylcarbazole, polyester, polyarylate, polyacrylate, polyether, polysulfone, and the like. Molecular weights can vary from about 20,000 to about 1,500,000. Other solvents that may dissolve these binders include tetrahydrofuran, toluene, trichloroethylene, 1,1,2-trichloroethane, 1,1,1-trichloroethane, and the like.

The thickness of the charge transport layer may range from about 10 micrometers to about 50 micrometers, or, alternatively, from about 20 micrometers to about 35 micrometers. In embodiments, thicknesses may range from about 23 micrometers to about 31 micrometers.

Optionally, an overcoat layer may also be utilized to protect the charge transport layer and improve resistance to abrasion. These overcoat layers are well known in the art and may include thermoplastic organic polymers or inorganic polymers that are electrically insulating or slightly semi-conductive. Overcoatings are continuous and generally have a thickness of less than about 10 micrometers.

An optional conventional anti-curl layer may also be employed. The anti-curl layer may include organic polymers or inorganic polymers that are electrically insulating or slightly semi-conductive. The anti-curl layer provides flatness and/or abrasion resistance. The anti-curl layer is formed at the back side of the substrate, opposite to the imaging layers. The thickness of the anti-curl layer is from about 3 micrometers to about 35 micrometers. In one embodiment, the thickness of the anti-curl layer is about 14 micrometers.

An optional conventional ground strip may be utilized along one edge of the imaging member. The ground strip may include a film forming polymer binder and electrically conductive particles. The ground strip may include materials including those enumerated in U.S. Pat. No. 4,664,995, the entire disclosure of which is incorporated herein by reference. The ground strip layer may have a thickness from about 7 micrometers to about 42 micrometers. In one embodiment, the ground strip layer may have a thickness from about 14 micrometers to about 23 micrometers.

The present invention also relates to processes for fabricating an imaging member described herein. In general, this process involves providing a support, providing a charge imaging layer, and forming an interfacial adhesive layer between the support and the charge imaging layer, wherein said interfacial adhesive layer may or may not be in direct contact with either the support or the charge imaging layer, and wherein said interfacial adhesive layer includes a copolyester-polycarbonate resin. In one embodiment, the charge blocking layer can be coated onto the support, the interfacial adhesive layer can be then coated on the charge blocking layer, and the charge generating layer then can be coated on the interfacial adhesive layer. Additional layers may also be added to the imaging member, including, for example, a charge transport layer, an undercoating, a conductive coating, an anti-curl layer, an overlayer, and the like. Because of its favorable viscosity, the interfacial adhesive layer may be applied using a slot die coating procedure.

In another embodiment, in fabricating the imaging member of the present invention, a charge generating material (CGM) and a charge transport material (CTM) may be deposited onto the support surface either in a laminate type configuration where the CGM and CTM are in different layers or in a single layer configuration where the CGM and CTM are in the same layer along with a binder resin. Thus, the imaging member may have one charge imaging layer or two charge imaging layers. Illustrative organic photoconductive charge generating materials include azo pigments such as Sudan Red, Dian Blue, Janus Green B, and the like; Quinone pigments such as Algol Yellow, PYRENE® Quinone, INDANTHRENE® Brilliant Violet RRP, and the like; quinocyanine pigments; perylene pigments; indigo pigments such as indigo, thioindigo, and the like; bisbenzoimidazole pigments such as INDOFAST® Orange toner, and the like; phthalocyanine pigments such as copper phthalocyanine, aluminochloro-phthalocyanine, and the like; quinacridone pigments; or azulene compounds. Suitable inorganic photoconductive charge generating materials include, for example, cadium sulfide, cadmium sulfoselenide, cadmium selenide, crystalline and amorphous selenium, lead oxide and other chalcogenides. Alloys of selenium are encompassed by embodiments of the instant invention and include for instance selenium-arsenic, selenium-tellurium-arsenic, and selenium-tellurium.

Other modifications of the present invention may occur to those skilled in the art subsequent to a review of the present application, and these modifications, including equivalents thereof, are intended to be included within the scope of the present invention. Further, the recited order of processing elements or sequences, or the use of numbers, letters, or other designations therefor, is not intended to limit the claimed processes to any order except as may be specified in the claims.

EXAMPLES

Example 1

A flexible imaging member was prepared by providing a titanium coated polyester substrate (MELINEX® 442, available from DUPONT®-TEIJIN® Films) having a thickness of 3 millimeters (76.2 micrometers) and applying thereto, using a ½ millimeter gap BIRD® applicator, a solution containing 10 grams 3-aminopropyltriethoxysilane, 10.1 grams distilled water, 3 grams acetic acid, 684.8 grams of 200 proof denatured alcohol and 200 grams heptane. This layer was then allowed to dry for 5 minutes at 135 degrees Celsius in a forced air oven. The resulting charge blocking layer had an average dry thickness of 0.05 micrometer measured with an ellipsometer.

An interfacial adhesive layer was then prepared by applying with a ½ mil gap BIRD® applicator to the charge blocking layer a wet coating containing 0.5 to 1.1 percent by weight based on the total weight of the solution of polyester adhesive (MORTON® 49,000, available from Morton International) in a 70:30 volume ratio mixture of tetrahydrofuran/cyclohexanone. The interfacial adhesive layer was allowed to dry for 5 minutes at 135 degrees Celsius in the forced air oven. The resulting interfacial adhesive layer had a dry thickness of 600 Angstroms (0.06 micrometer).

The interfacial adhesive layer was thereafter coated with a charge generating layer containing 40 percent by volume benzimidazole perylene (BzP) and 60 percent by volume poly(4,4'-diphenyl-1,1'-cyclohexane carbonate). This charge generating layer was prepared by introducing 0.3 grams of poly(4,4'-diphenyl-1,1'-cyclohexane carbonate) PCZ-200, available from Mitsubishi Gas Chem., and 48 milliliter of tetrahydrofuran into a 4 ounce amber bottle. To this solution was added 1.6 gram of benzimidazole perylene and 300 grams of ⅛ inch diameter stainless steel shot. This mixture was then placed on a ball mill for 96 hours. Ten grams of the resulting dispersion was added to a solution containing 0.547 grams of poly(4,4'-diphenyl-1,1'-cyclohexane carbonate) PCZ-200 and 6.14 grams of tetrahydrofuran. The resulting slurry was thereafter applied to the adhesive interface with a ½-millimeter gap BIRD® applicator to form a layer having a wet thickness of 0.5 millimeter. The layer was dried at 135 degrees Celsius for 5 minutes in a forced air oven to form a dry thickness charge generating layer having a thickness of about 1.2 micrometers.

This charge generating layer was overcoated with a charge transport layer. The charge transport layer was prepared by introducing into an amber glass bottle in a weight ratio of a hole transporting molecule of 1:1 N,N'-diphenyl-N,N'-bis(3-methylphenyl)-1,1'-biphenyl-4,4'-diamine and MAKROLON®, a polycarbonate resin having a molecular weight of from about 50,000 to 150,000 commercially available from Farbenfabriken Bayer A.G. The resulting mixture was dissolved in methylene chloride to form a solution containing 15 percent by weight solids. This solution was applied on the charge generating layer using a 4-millimeter gap BIRD® applicator to form a coating which upon drying had a thickness of 24 microns. During this coating process the humidity was equal to or less than 15 percent. The photoreceptor device containing all of the above layers was annealed at 135 degrees Celsius in a forced air oven for 5 minutes and thereafter cooled to ambient room temperature. After application of the charge transport layer coating, the imaging member spontaneously curled upwardly.

Example 2

A second flexible imaging member was prepared by following the procedures and using the same materials as described in Example 1, except that the interfacial adhesive layer contained a copolyester-polycarbonate resin (LEXAN® ML 5273-111, GE Plastics, Pittsfield, MA) instead of the MORTON® 49,000. The solution for the copolyester-polycarbonate resin is referred to as copoly (bisphenol-A/phthalic acid dichloride ester carbonate) (PCE) (CAS Registration No. 71519-80-7). The copolyester-polycarbonate resin may also be referred to as bisphenol-A/isophthaloyldichloride/terephthaloyldichloride copolyester carbonate.

Example 3

A third flexible imaging member was prepared by following the procedures and using the same materials as described in Example 1, except that the charge generating layer contained 40 percent by volume hydroxygallium phthalocyanine, and 60 percent by volume poly(4,4'-diphenyl-1,1'-cyclohexane carbonate. This charge generating layer was prepared by introducing 0.45 gram poly(4,4'-diphenyl-1,1'-cyclohexane carbonate) PCZ-200, available from Mitsubishi Gas Chem., and 45 grams of tetrahydrofuran into a 4 ounce amber bottle. To this solution was added 2.4 grams of Hydroxygallium phthalocyanine and 300 grams of ⅛ inch (3.2 millimeter) diameter stainless steel shot. This mixture was then placed on a ball mill for 24 hours. Subsequently, 10 grams of the resulting slurry were added to a solution of 0.47 gram PCZ-200 dissolved in 7.42 grams tetrahydrofuran. This slurry was then placed on a shaker for 10 minutes. The resulting slurry was thereafter applied to the interfacial adhesive layer by using a ¼ millimeter gap BIRD® applicator to form a coating layer having a wet thickness of 0.25 millimeter. This charge generating layer was dried at 135 degrees Celsius for 5 minutes in the forced air oven to form a dry thickness charge generating layer having a thickness of 1.0 micrometers.

Further, this charge generating layer was overcoated with a charge transport layer. The charge transport layer was prepared by introducing into an amber glass bottle in a weight ratio of a hole transporting molecule of 1:1 N,N'-diphenyl-N,N'-bis(3-methylphenyl)-1,1'-biphenyl-4,4'-diainine and MAKROLON®, a polycarbonate resin having a molecular weight of from about 50,000 to 150,000 commercially available from Farbenfabriken Bayer A.G. The resulting mixture was dissolved in methylene chloride to form a solution containing 15 percent by weight solids. This solution was applied on the charge generating layer using a 4-millimeter gap BIRD® applicator to form a coating which upon drying had a thickness of 29 microns. During this coating process the humidity was equal to or less than 15 percent. The photoreceptor device containing all of the above layers was annealed at 135 degrees Celsius in a forced air oven for 5 minutes and thereafter cooled to ambient room temperature.

Example 4

A fourth flexible imaging member was prepared by following the procedures and using the same materials as described in Example 3, except that the interfacial adhesive layer contained a copolyester-polycarbonate resin (LEXAN® ML 5273-111, GE Plastics, Pittsfield, MA) instead of MORTON® 49,000. The solution for the copolyester-polycarbonate resin may also be referred to in the art as copoly(bisphenol-A/phthalic acid dichloride ester carbonate) (PCE) (CAS No. 71519-80-7). The copolyester-polycarbonate resin is also referred to as bisphenol-A/isophthaloyldichloride/terephthaloyldichloride copolyester carbonate.

Example 5

Adhesive Strength Tests

The imaging members described in Examples 1 through 4 were evaluated for their adhesive properties using a 180-degree (reverse) peel test method.

The 180-degree peel strength is determined by cutting a minimum of five 0.5 inch×6 inches imaging member samples from each of Examples 1 through 4. For each sample, the charge transport layer is partially stripped from the test imaging member sample with the aid of a razor blade and then hand peeled to about 3.5 inches from one end to expose part of the underlying charge generating layer. The test imaging member sample is secured with its charge transport layer surface toward a 1 inch×6 inches×0.5 inch aluminum backing plate with the aid of two sided adhesive tape, 1.3 centimeters (½ inch) width SCOTCH® Magic Tape #810, available from 3M Company. At this condition, the anti-curl layer/substrate of the stripped segment of the test sample can easily be peeled away 180 degrees from the sample to cause the adhesive layer to separate from the charge generating layer. The end of the resulting assembly opposite to the end from which the charge transport layer is not stripped is inserted into the lower jaw of an INSTRON® Tetisile Tester. The free end of the partially peeled anti-curl/substrate strip is inserted into the upper jaw of the INSTRON® Tensile Tester. The jaws are then activated at a 1 inch/min crosshead speed, a 2 inch chart speed, and a load range of 200 grams, to 180 degrees to peel the sample at least 2 inches. The load monitored with a chart recorder is calculated to give the peel strength by dividing the average load in grams/0.5 inches required for stripping the anti-curl layer with the substrate by 12.7 millimeter/0.5 inches and multiplying by 10 millimeter/centimeter to get a value with units of grams/centimeter.

The adhesive strength of the imaging members described in Examples 1 through 4 were also analyzed using a 90-degree normal peel test method. The 90-degree normal peel test method measures the adhesive strength between the charge transport layer and the charge generating layer.

The results from the reverse and normal peel tests are described in Table 1 below. It is apparent that the use of the copolyester-polycarbonate resin (LEXAN® ML5273-111) provides increased peel strength over the 49K polyester resin.

TABLE 1

Reverse and Normal Peel Test Results

| Description | | Adhesion (g/cm) | |
|---|---|---|---|
| Example | IFL[1] | Reverse | Normal |
| 1 | 49K | 7.8 | 129.7 |
| 2 | LEXAN ® | 16.7 | >200 |
| 3 | 49K | 5.4 | 90.6 |
| 4 | LEXAN ® | 5.2 | 114.9 |

[1]"IFL" refers to the composition used in the interfacial adhesive layer.

Example 6

Electronic Properties Tests

The electrical properties of the imaging members prepared according to Examples 1 through 4 were evaluated with a xerographic testing scanner including a cylindrical aluminum drum having a diameter of 24.26 centimeters (9.55 inches). The test samples were taped onto the drum. When rotated, the drum carrying the samples produced a constant surface speed of 76.3 centimeters (30 inches) per second. A direct current pin corotron, exposure light, erase light, and five electrometer probes were mounted around the periphery of the mounted photoreceptor samples. The sample charging time was 33 milliseconds. The expose light had a 670 nanometers output and erase light was broad band white light (400–700 nm) output, each supplied by a 300 watt output Xenon arc lamp. The test samples were first rested in the dark for at least 60 minutes to ensure achievement of equilibrium with the testing conditions at 40 percent relative humidity and 21 degrees Celsius. Each sample was then negatively charged in the dark to a development potential of about 900 volts. The charge acceptance of each sample and its residual potential after discharge by front erase exposure to 400 ergs/cm$^2$ were recorded. Dark Decay was measured as a loss of Vddp after 0.66 seconds. The test procedure was repeated to determine the photo induced discharge characteristic (PIDC) of each sample by different light energies of up to 20 ergs/cm$^2$. The photodischarge is given as the ergs/cm$^2$ needed to discharge the photoreceptor from a Vddp of 800 volts or 600 volts to 100 volts, QV intercept is an indicator of depletion charging.

The results from the electrical testing are included in Table 2 below. No detrimental effects were observed with use of copolyester-polycarbonate resin (LEXAN® ML5273-111) in place of the 49K polyester resin.

TABLE 2

Electrical Properties Test Results

| Sample | Photodischarge: 600 to 100 volts (Ergs/cm2) | Dark Decay (Volts/sec) | QV Intercept (Volts) | Residual (Volts) |
|---|---|---|---|---|
| Example 1 | 9.09 | −33 | 46 | 35 |
| Example 2 | 8.01 | −13 | 65 | 38 |
| Example 3 | 2.92 | −60 | 31 | 29 |
| Example 4 | 3.59 | −112 | 21 | 33 |

Other modifications of the present invention may occur to those skilled in the art subsequent to a review of the present application, and these modifications, including equivalents thereof, substantial equivalents, similar equivalents, and the like, are intended to be included within the scope of the present invention. Further, the recited order of processing elements or sequences, or the use of numbers, letters, or other designations therefor, is not intended to limit the claimed processes to any order except as may be specified in the claims.

What is claimed is:

1. An imaging member comprising: a support comprising an electrically conductive substrate; a charge blocking layer; an interfacial adhesive layer comprising a copolyester-polycarbonate resin; and a charge imaging layer, wherein the interfacial adhesive layer is disposed between the charge blocking layer and the charge imaging layer.

2. The imaging member according to claim 1, wherein said copolyester-polycarbonate resin comprises a dihydric phenol constituent and an acid dichloride constituent.

3. The imaging member according to claim 2, wherein said dihydric phenol constituent is bisphenol-A.

4. The imaging member according to claim 2, wherein said acid dichloride constituent is selected from the group consisting of isophthaloyl dichloride, terephthaloyl dichloride, and mixtures thereof.

5. The imaging member according to claim 1, wherein said copolyester-polycarbonate resin comprises a copolymer of bisphenol-A and a phthalic acid dichloride ester, and wherein said copolyester-polycarbonate resin comprises a polymer chain represented by the following formula: $(X.Y.Z.T)_n$, wherein:

X is a compound having an empirical formula of $C_{15}H_{16}O_2$, represented by the following structure:

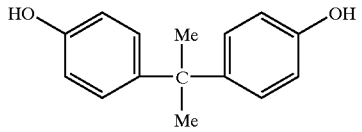

Y is a compound having an empirical formula of $C_{15}H_{16}O_2$, represented by following structure:

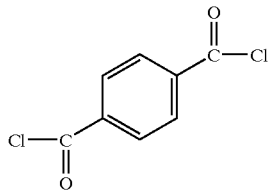

Z is a compound having an empirical formula of $C_8H_4Cl_2O_2$, represented by the following structure:

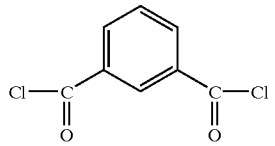

T is a compound having an empirical formula of $CCl_2O$, represented by the following structure:

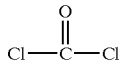

wherein n is an integer ranging from between about 1 and 1000.

6. The imaging member according to claim 5, wherein n is an integer ranging from between about 100 and 500.

7. The imaging member according to claim 5, wherein said polymer chain has a molecular topology selected from the group consisting of linear, branched, and crosslinked.

8. The imaging member according to claim 1, wherein said copolyester-polycarbonate resin is 1,3-benzenedicarbonyl dichloride, polymer with 1,4-benzenedicarbonyl dichloride, carbonic dichloride and 4,4'-(1-methylethylidene)bis[phenol].

9. The imaging member according to claim 1, wherein said copolyester-polycarbonate resin has a weight average molecular weight of from about 110,000 to about 500,000.

10. The imaging member according to claim 1, wherein said copolyester-polycarbonate resin has a weight average molecular weight of from about 175,000 to about 225,000.

11. The imaging member according to claim 1, wherein the interfacial adhesive layer has a dry thickness between about 50 and about 5000 Ångstroms.

12. The imaging member according to claim 1, wherein the interfacial adhesive layer has a dry thickness between about 100 and about 3000 Ångstroms.

13. The imaging member according to claim 1, wherein the interfacial adhesive layer has a dry thickness between about 300 and about 1000 Ångstroms.

14. The imaging member according to claim 1, wherein said charge imaging layer comprises particles or layers of a photoconductive material.

15. The imaging member according to claim 14, wherein said photoconductive material is benzimidazole perylene.

16. The imaging member according to claim 14, wherein said photo conductive material is hydroxygallium phthalocyanine.

17. The imaging member according to claim 14, wherein said photoconductive material is selected from the group consisting of vanadyl phthalocyanine, metal free phthalocyanine, amorphous selenium, trigonal selenium, selenium alloys selected from the group consisting of selenium-tellurium, selenium-telluriumarsenic, and selenium arsenide, and mixtures thereof.

18. The imaging member according to claim 1, wherein said support is rigid or flexible.

19. The imaging member according to claim 1, wherein said support has a structural form selected from the group consisting of a plate, a flexible sheet, a cylindrical drum, a scroll, and an endless flexible belt.

20. The imaging member according to claim 1, wherein said charge imaging layer comprises a charge generating layer and a charge transport layer.

21. The imaging member according to claim 20, wherein the charge generating layer is disposed next to the interfacial adhesive layer, and said interfacial adhesive layer has an adhesive strength of between about 5.0 and about 30.0 g/cm, as measured using a reverse peel test, wherein said reverse peel test measures the amount of force required to cause the interfacial adhesive layer to separate from the charge generating layer.

22. The imaging member according to claim 20, wherein said imaging member has an adhesive strength of at least 100 g/cm, as measured using a 90-degree normal peel test, wherein said 90-degree normal peel test measures the amount of force required to cause the charge transport layer to separate from the charge generating layer.

23. The imaging member according to claim 1, further comprising an anti-curl backing layer.

24. The imaging member according to claim 1, further comprising an overcoating layer.

25. A process for fabricating an imaging member, comprising:

providing a support comprising an electrically conductive substrate;

providing a charge blocking layer;

providing a charge imaging layer; and forming an interfacial adhesive layer between the charge blocking layer and the charge imaging layer, wherein said interfacial adhesive layer may or may not be in direct contact with either the charge blocking layer or the charge imaging layer, and wherein said interfacial adhesive layer comprises a copolyester-polycarbonate resin.

26. The process according to claim 25, wherein said copolyester-polycarbonate resin comprises a dihydric phenol constituent and an acid dichloride constituent.

27. The process according to claim 26, wherein said dihydric phenol constituent is bisphenol-A.

28. The process according to claim 26, wherein said acid dichloride constituent is selected from the group consisting of isophthaloyl dichloride, terephthaloyl dichloride, and mixtures thereof.

29. The process according to claim 25, wherein said copolyester-polycarbonate resin is 1,3-benzenedicarbonyl dichloride, polymer with 1,4-benzenedicarbonyl dichloride, carbonic dichloride and 4,4'-(1-methylethylidene)bis[phenol].

30. The process according to claim 25, wherein said interfacial adhesive layer is applied using a slot die coating procedure.

* * * * *